US006186117B1

(12) United States Patent
Matte

(10) Patent No.: US 6,186,117 B1
(45) **Date of Patent: *Feb. 13, 2001**

(54) ELECTRONIC COMPENSATION SYSTEM

(75) Inventor: Sylvain Matte, St-Denis de Brompton (CA)

(73) Assignee: Bombardier Inc., Montreal (CA)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/948,064

(22) Filed: Oct. 9, 1997

(30) Foreign Application Priority Data

Oct. 9, 1996 (CA) ..... 2187499

(51) Int. Cl.[7] ..... F02M 7/00
(52) U.S. Cl. ..... 123/437; 123/75 AD; 261/DIG. 67
(58) Field of Search ..... 123/73 AD, 437, 123/438; 261/DIG. 67

(56) References Cited

U.S. PATENT DOCUMENTS 3,080,858 * 3/1963 Kane ..... 261/DIG. 67
3,656,736 * 4/1972 York ..... 261/DIG. 67
3,730,157 5/1973 Gerhold .
3,789,812 2/1974 Berry et al. .
3,921,612 * 11/1975 Aono ..... 261/DIG. 67
3,974,813 * 8/1976 Knapp ..... 261/DIG. 67
4,016,848 * 4/1977 Nagai ..... 261/DIG. 67
4,187,805 * 2/1980 Abbey ..... 261/DIG. 67
4,216,174 * 8/1980 Szott ..... 261/DIG. 67
4,556,081 * 12/1985 Sugiura ..... 261/DIG. 67
4,813,391 * 3/1989 Geyer ..... 123/73 AD
5,021,198 6/1991 Bostelmann .
5,879,595 * 3/1999 Holtzman ..... 261/DIG. 67

* cited by examiner

*Primary Examiner*—Carl S. Miller
(74) *Attorney, Agent, or Firm*—Pillsbury Madison & Sutro LLP

(57) ABSTRACT

The air/fuel mixture ratio supplied to an internal combustion engine of a vehicle is modified to achieve a constant mass flow rate in spite of changes in atmospheric temperature and pressure conditions by employing an electronic compensation system. The system has sensors which detect air temperature and barometric pressure, from which signals are developed controlling the float bowl pressure in the engine carburettors, thus modifying the air/fuel mixture ratio as desired. The system also includes provision for enriching the fuel content of the mixture supplied to the engine to provide an oversupply of fuel in cold start situations.

23 Claims, 5 Drawing Sheets

ELECTRONIC COMPENSATION SYSTEM

BACKGROUND OF THE INVENTION

A. Field of the Invention

This invention relates to a new or improved fuel supply system for an internal combustion engine, to a manifold specifically designed for use in such system, to a kit of parts to enable retrofitting of such system in an existing engine and to a method of controlling the fuel supply to achieve the improved response to a number of environmental conditions.

B. Description of the Prior Art

In internal combustion engines having carburetor controlled fuel supplies, as is typical of engines used in vehicles such as snowmobiles and personal watercraft, it is well known that the rate of fuel flow in a fixed or variable venturi carburetor is dependent upon the pressure differential existing in the fuel system between the venturi and e.g. a fuel bowl (otherwise called a float bowl or a float chamber). In a conventional float bowl carburetor the pressure differential is measured between the pressure in the fluid float chamber (which is normally atmospheric pressure) and the pressure at the discharge orifice of the fuel metering system which is normally located in or adjacent the venturi in the induction passage.

For optimum combustion, the relationship between the mass air flow and the mass fuel flow delivered to the engine by the carburetor should be kept constant, and to achieve this the carburetor employs either a fixed or a variable venturi (or some equivalent structure) such that when air velocity in the induction passage is increased a pressure reduction (often called a vacuum) is created in the venturi zone. This pressure reduction creates a pressure differential between the induction passage and the fuel in the float chamber, causing fuel to be drawn into the induction passage at a flow rate that is proportional to the pressure differential.

The amount or level of the venturi underpressure or vacuum is mainly a function of air velocity through the induction passage, but as is well understood, at a given velocity, the mass air flow rate is affected by air density which in turn is mainly a function of barometric pressure and air temperature.

For example for a snowmobile operating at an altitude of 2000 meters, a given air velocity in the carburetor induction passage will deliver a very much reduced mass air flow to the engine as compared to the same air velocity when the snowmobile in operating at seal level, this being due to the reduced barometric pressure and air density at altitude. However since fuel flow is mostly a function of the venturi underpressure or vacuum, the engine when operating at altitude would tend to be supplied with a mixture that is over rich in fuel. This phenomenon is well understood. For example U.S. Pat. No. 5,021,198 Bostelmann discloses a carburetor system that is designed to adjust the fuel flow to maintain the mass air fuel mixture ratio constant despite changes in altitude.

SUMMARY OF THE INVENTION

It is an object of the invention to provide a fuel supply control system and method which without the use of a choke or the like is adapted to adjust the air fuel mass flow ratio to provide a fuel enriched mixture in certain situations, e.g. for starting a cold engine.

The invention provides a method for modifying the air/fuel mixture ratio supplied to an internal combustion engine of a vehicle to achieve a constant mass flow ratio in spite of changes in atmospheric temperature conditions, said fuel being drawn from a float chamber into a venturi in a carburetor, wherein it is mixed with air before being delivered into the engine, said method comprising: (a) sensing the atmospheric temperature in the vicinity of said vehicle and generating a signal indicative of said sensed temperature; (b) supplying said signal to a control unit; (c) operating said control unit to modify pressure within said float chamber thus varying the pressure differential between the venturi and said float chamber so that the mass flow ratio of said mixture remains substantially constant.

The engine preferably also includes an air pressure sensor and an engine temperature sensor both of which feed signals to the electronic control unit which signals are also used in modifying the fuel/air ratio of the mixture.

From another aspect the invention provides a method for reducing the air/fuel mixture ratio supplied to an internal combustion engine in cold start situations, said fuel being drawn from a float chamber into a venturi in a carburetor where it is mixed with air and delivered into the engine, said method comprising: (a) sensing the temperature of the engine and generating a signal when said temperature is below a normal operating temperature range; (b) supplying said signal to a control unit; (c) operating said control unit to elevate the pressure within said float chamber to increase fuel flow into the venturi and thus increase the fuel content of said mixture during periods when said signal is received.

The engine crankcase chamber is subject to pressure fluctuations during operation of the engine, and this chamber can be utilized as the pressure generator by including a line communicating the crankcase chamber to the control unit. At low speeds of rotation of the engine corresponding to cranking thereof this line will provide a sufficient flow of pressurized air. However at higher engine speeds and throttle openings the pressure will be insufficient so that an external pump may be required. Preferably such pump is a mechanical pump constructed to be driven by pressure pulse in the crankcase chamber. The pump is provided for delivering the flow of pressurized air at higher speeds of operation of the engine, i.e. at speeds of idling and above. Alternatively, the pressure generator may be a separate pump, for example electrically driven from a vehicle battery.

DESCRIPTION OF THE DRAWINGS

The invention will further be described, by way of example only, with reference to the accompanying drawings wherein.

DESCRIPTION OF THE PREFERRED EMBODIMENT

The fuel flow control system incorporates an electronic control unit which is coupled to receive inputs from a series of sensors and provide output signals to control the fuel flow from the carburetor or carburetors. The invention as described concerns a fuel supply system in a snowmobile engine, but obviously is susceptible of many other applications.

Figure 1:
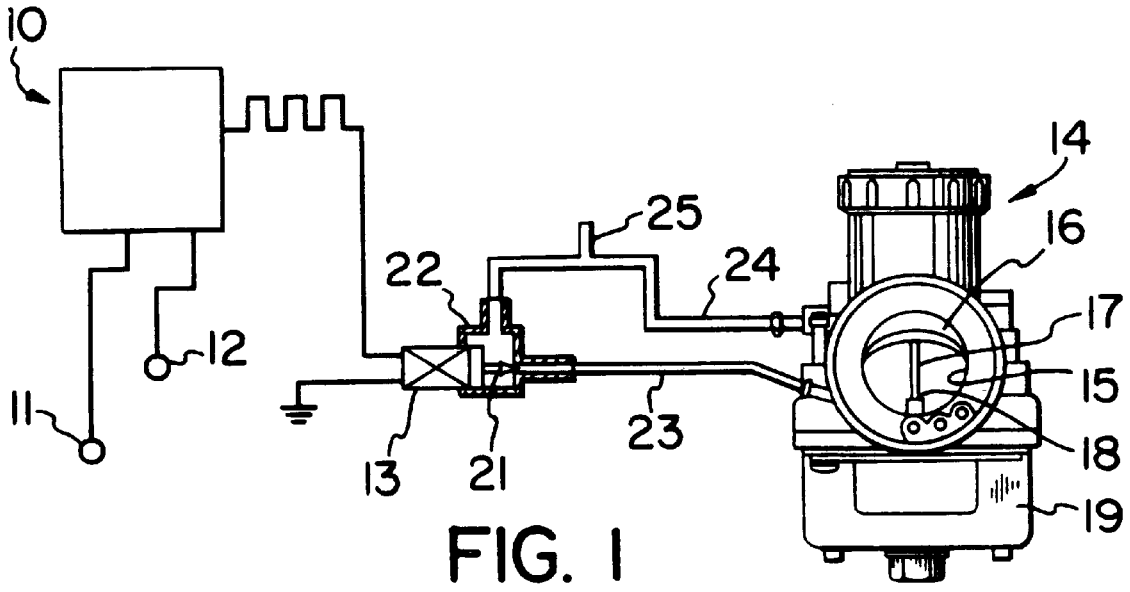
FIG. 1 is a schematic view of a first portion of a fuel supply control system in a snowmobile engine.

Referring to FIG. 1, an electronic control unit (ECU) 10 is connected to receive input signals from a barometric pressure sensor 11 and an air temperature sensor 12, these sensors being mounted at locations on the snowmobile where they are exposed to atmospheric conditions. The signals from the sensors 11 and 12 are processed by the ECU which produce an output signal that is sent to a solenoid 13 by means of which the fuel flow from a carburetor 14 is adjusted to compensate for air density at the location where a snowmobile is operating. As mentioned above, air density is mainly a function both of barometric pressure and of air temperature, and by measuring these parameters by means of the sensors 11 and 12 the ECU produces an output signal which modifies fuel flow to the snowmobile engine to compensate for changes in the measured parameters.

The engine has a carburetor 14 that is of a well known type having an induction passage 15 controlled by a spring loaded sliding piston 16 which carries a needle 17 slidably inserted in a fuel orifice 18 connected to draw fuel from a float chamber 19. The induction passage comprises a venturi which creates an underpressure or vacuum in the air flowing therethrough, the pressure differential between the venturi and the float chamber 19 resulting in fuel being drawn into the induction passage through the orifice 18 and thereafter delivered to the engine in mixture with the air flow.

The solenoid valve 13 is designed to create a controlled reduction of the pressure in the float chamber so that the flow of fuel from the orifice 18 is modified in accordance with the atmospheric air density with the result that the mass air/fuel flow ratio is held substantially constant.

The solenoid valve has a valve closure 21 mounted in a manifold chamber 22 to which is coupled a first conduit 23 which is in communication with the venturi of the induction passage 15 adjacent the orifice 18, and a second conduit 24 which is in communication with the carburetor float chamber 19, this second conduit including an atmospheric vent 25.

In operation, the above described system acts to compensate for the mass air flow diminution (which occurs when the snowmobile is operating at high altitudes) by reducing the pressure within the float chamber 19 which in turn reduces the pressure differential acting on the fuel thus reducing the fuel flow. To achieve the necessary reduction in pressure, the system utilizes the underpressure or vacuum in the induction passage venturi and applies this through the conduit 23, the manifold 22, and the conduit 24 to the float chamber. The extent to which the float chamber is exposed to this underpressure is determined by the solenoid valve 23 the closure 21 of which cooperates with the end of the conduit 13 to open this to a greater or lesser extent in accordance with the prevailing atmospheric conditions. For example the ECU 10 would be calibrated so that at some standard condition of temperature and barometric pressure, the closure 21 would completely seal the conduit 23 so that the float chamber would be exposed to only atmospheric pressure via the vent 25 and the conduit 24.

Figure 2:
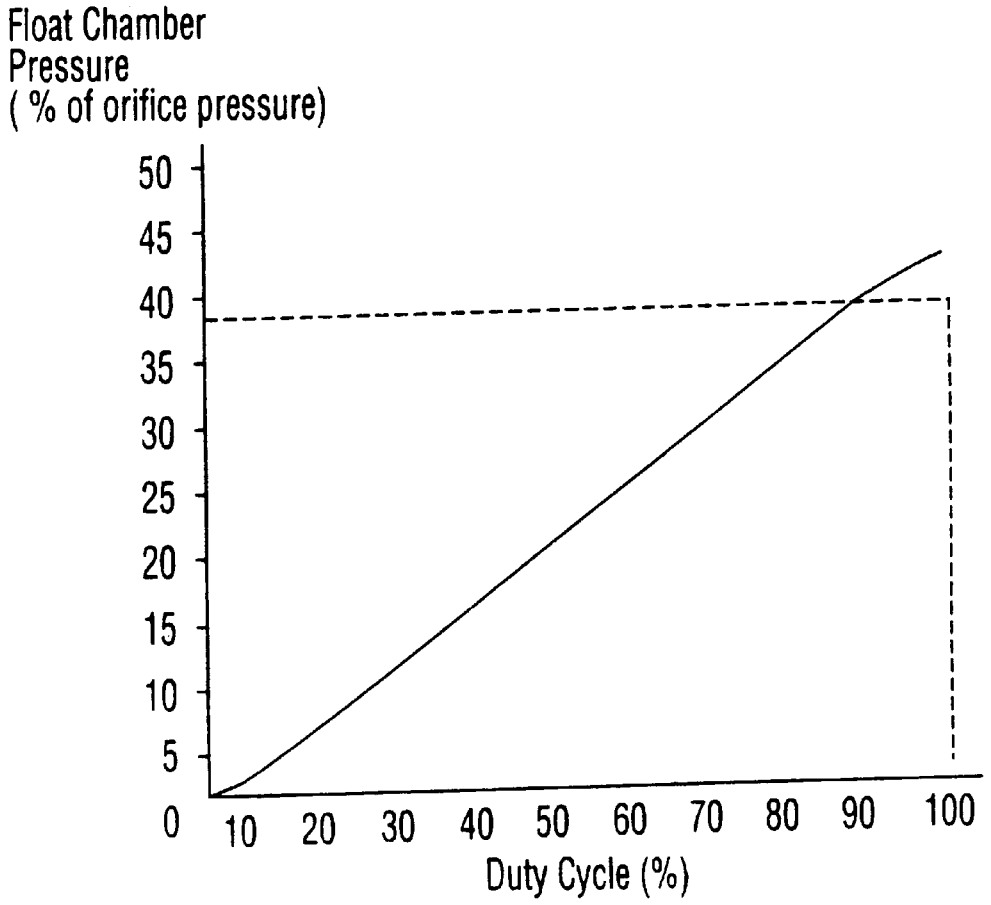
FIG. 2 is a graph showing the carburetor float chamber pressure as it varies with operating conditions.

By arranging that the conduit 23 opens into the induction passage 15 at a location very close to the fuel orifice 18 it is ensured that the compensation is essentially linear at any throttle opening condition, as illustrated in FIG. 2 which shows the float chamber pressure as a percentage of the pressure at the fuel orifice 18 throughout the duty cycle activation of the solenoid valve 13. In other words the float chamber pressure is directly related to the underpressure or vacuum around the discharge fuel orifice 18 in the induction passage.

Thus if the snowmobile is operating at high altitude, the ECU will respond to the signals received from the sensors 11 and 12 to activate the solenoid valve 13 in such a duty cycle that the float chamber pressure is reduced to ensure that a constant mass air/fuel mixture is delivered by the carburettor to the engine.

By "duty cycle" is meant the percentage of the opening time of the solenoid valve 13 in relation to its fixed cycle time. For example if the cycle time of the solenoid valve 13 is 0.1 seconds, and the duty cycle is 50%, then the opening time of the solenoid valve 13 during each cycle will be 0.05 seconds.

Referring to FIG. 2, at standard atmospheric pressure and temperature conditions, the ECU does not deliver any signal to the solenoid valve 13 which therefore remains closed and the float chamber 19 is at atmospheric pressure, this corresponding to a duty cycle percentage of 0 at the solenoid valve 13. At increasing altitude, the air density is reduced so that the ECU 10 in response to signals received from the sensors 11 and 12 will deliver a signal to the solenoid valve 13 opening it for a percentage of its duty cycle corresponding to the specific atmospheric conditions of pressure and temperature that have been sensed so that the float chamber through the conduit 24 is exposed to an under pressure or vacuum as indicated by the graph in FIG. 2. This system is calibrated such that at a 100% duty cycle of the solenoid vale 13 (corresponding to the minimum air density atmospheric conditions which will be encountered) the float chamber under pressure will as shown be approximately 40% of the vacuum in the induction passage 15 at the location of the fuel orifice 18. Between these two extremes the change is essentially linear.

It will be understood that it is at all times possible to alter the mass air/fuel ratio in response to the above discussed or other parameters by feeding appropriate signals to the ECU 10.

In some circumstances it is desirable to provide a fuel-enriched air/fuel mixture to the engine, e.g. during cold starting of the engine. Traditionally this has been done by use of a manual or automatic choke or primer. In the present invention however this function is also included in the fuel supply control system, and is also monitored by the electronic control unit which acts to increase the pressure within the float chamber 19 to provide the mixture enrichment required during engine start-up and during warming up of the engine from a cold start.

Figure 3:
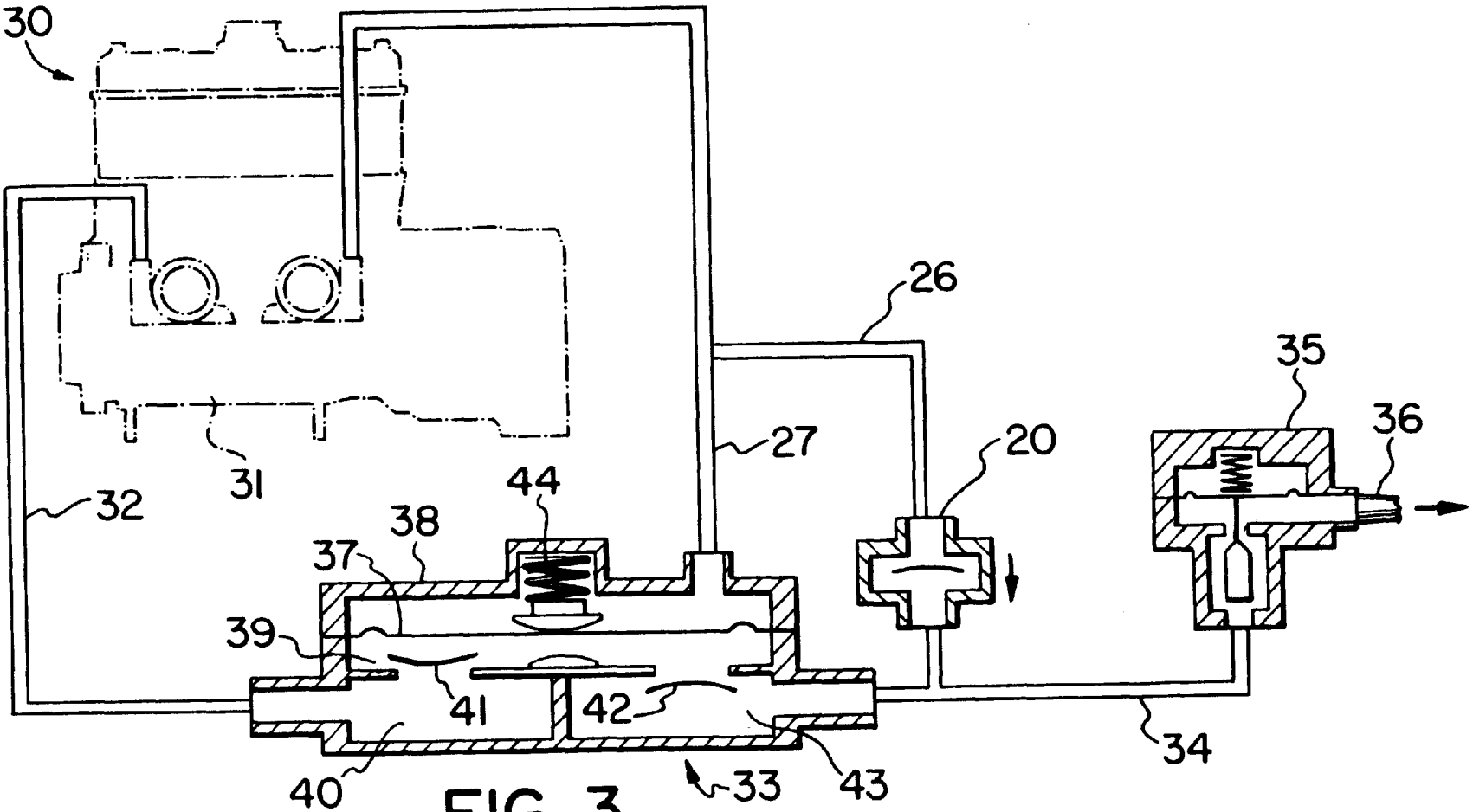
FIG. 3 is a schematic view showing a second part of the fuel supply control system.

Referring to FIG. 3 there is shown a snowmobile engine 30 is a two stroke internal combustion engine having a crankcase 31 in which pre-compression of the air/fuel discharge is carried out prior to the latter being delivered into the engine cylinders. During low speed rotation of the engine crankshaft (e.g. between 200 and 900 rpm) the pressure changes that occur during pre compression of the charge in the crankcase can be utilized, and to this end a pressure line 26 communicates with the crankcase interior and through a check valve 20 and a pressure line 34 supplies crankcase gases to a pressure regulator 35, the latter supplying a regulated pressure flow to a pressure line 36.

This first pressure source as mentioned is useful only at low engine rpm because for a given throttle opening the available pressure decreases with increasing rpm, as is well understood in the technology of two stroke engine applications. In effect, this pressure source is only useful during the cranking stage of operation of the snowmobile engine under consideration, the cranking speed being of the order of 500 rpm. The idle speed of the engine is about 1,700 rpm which is well above the range when any useful pressure output can be obtained from the above described pressure source. Therefore at higher speeds, the second pressure source is provided by utilizing the pressure pulsations occurring in the crankcase to drive a diaphragm air pump 33. Thus as seen in FIG. 3 the air pump 33 is divided by a movable diaphragm 37, the chamber 38 on the upper side of the diaphragm being in communication with a branch 27 of the pressure line 26. On the underside of the diaphragm there is a pumping chamber 39 designed to draw air from a line 32 (connected to the interior of the crankcase) through a plenum 40 and a non-return valve 42 and to deliver air under pressure past a second non return valve 42 into an output chamber 43 which communicates with the pressure line 34.

In operation, at low engine rpm as during cranking, as described above a supply pressurized air is delivered through the line 26 and through the check valve 20 and the pressure line 34 to the regulator 35.

At higher engine speeds, e.g. at the idling speed of 1,500 rpm, as explained, the line 26 no longer delivers an adequate flow of pressurized air. However in these circumstances the pulsations from the crankcase through the lines 26, 27 produce a rapid fluctuation in the position of the diaphragm 37 against the force of its return spring 44. These fluctuations of the diaphragm cause small amounts of air from the line 32 to be drawn in past the one way valve 41 when the diaphragm moves upwards, and then to be driven out of the pumping chamber 39 past the one way valve 42 when the diaphragm is moved downwards thus supplying a pressurized air flow to the line 34 and the regulator 35.

Figure 4:
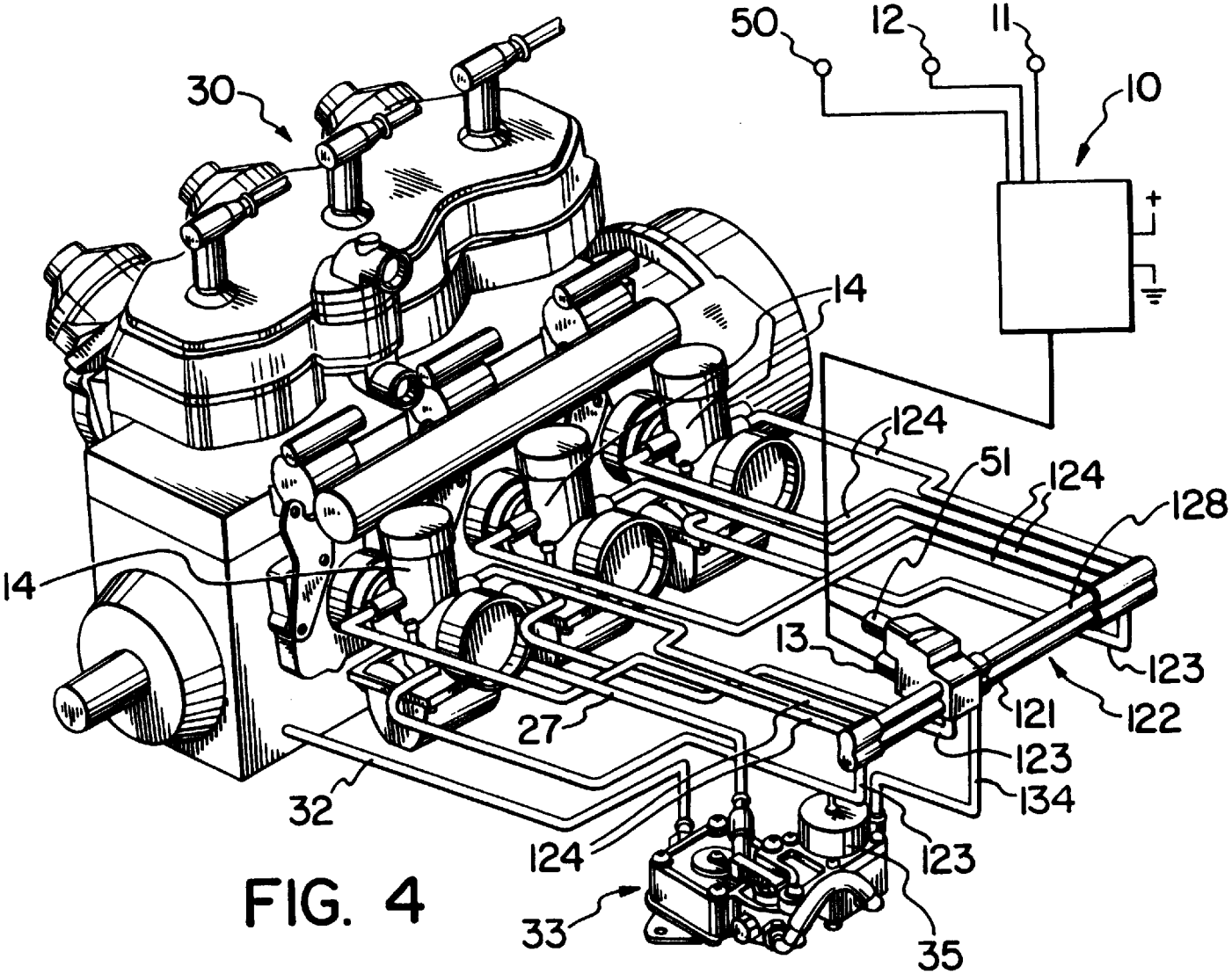
FIG. 4 is a schematic view of the overall fuel control system of a three cylinder two-stroke engine.

FIG. 4 shows a fuel flow control system which incorporates elements from not FIGS. 1 and 3, and where possible like reference numerals are used to illustrate like parts.

The electronic control unit 10 is coupled to receive signals from the barometric pressure sensor 11, the air temperature sensor 12 and an engine temperature sensor 50 and utilizes signals received from these sensors to control the fuel supply to the engine 30 in the desired manner. As described in relation to FIG. 1, the ECU 10 delivers a control signal to a solenoid 13 which is mounted in a manifold 122 the interior of which communicates with the floor chambers 19 of each of three carburetors 14 through conduits 124 and which communicates with atmosphere through a vent orifice 125 (FIG. 5*c*). A vacuum conduit system 123 is exposed to the pressure within the induction passage venturi of each of the carburetors and communicates this pressure to the manifold 122 under control of the closure 121 of the solenoid 13. The manifold 122 also carries a second solenoid 51 which is connected to the ECU 10 and controls the supply of pressurized air from the line 136 to the manifold 122 in accordance with signals received from the engine temperature sensor 50. Although not shown in FIG. 4, the system for generating pressure from the engine crankcase as shown in FIG. 3 is included, and the output pressure line 136 therefrom is connected to the interior of the manifold 122, this connection being regulated by the solenoid 51.

From the foregoing it will be appreciated that the pressure in the carburetor float chambers 10 is regulated under the control of the ECU 10 in response to signals received from the sensors 11, 12 and 50 to provide a mass air/fuel flow mixture having the desired characteristics in relation to various operating conditions of the engine.

Figure 5A:
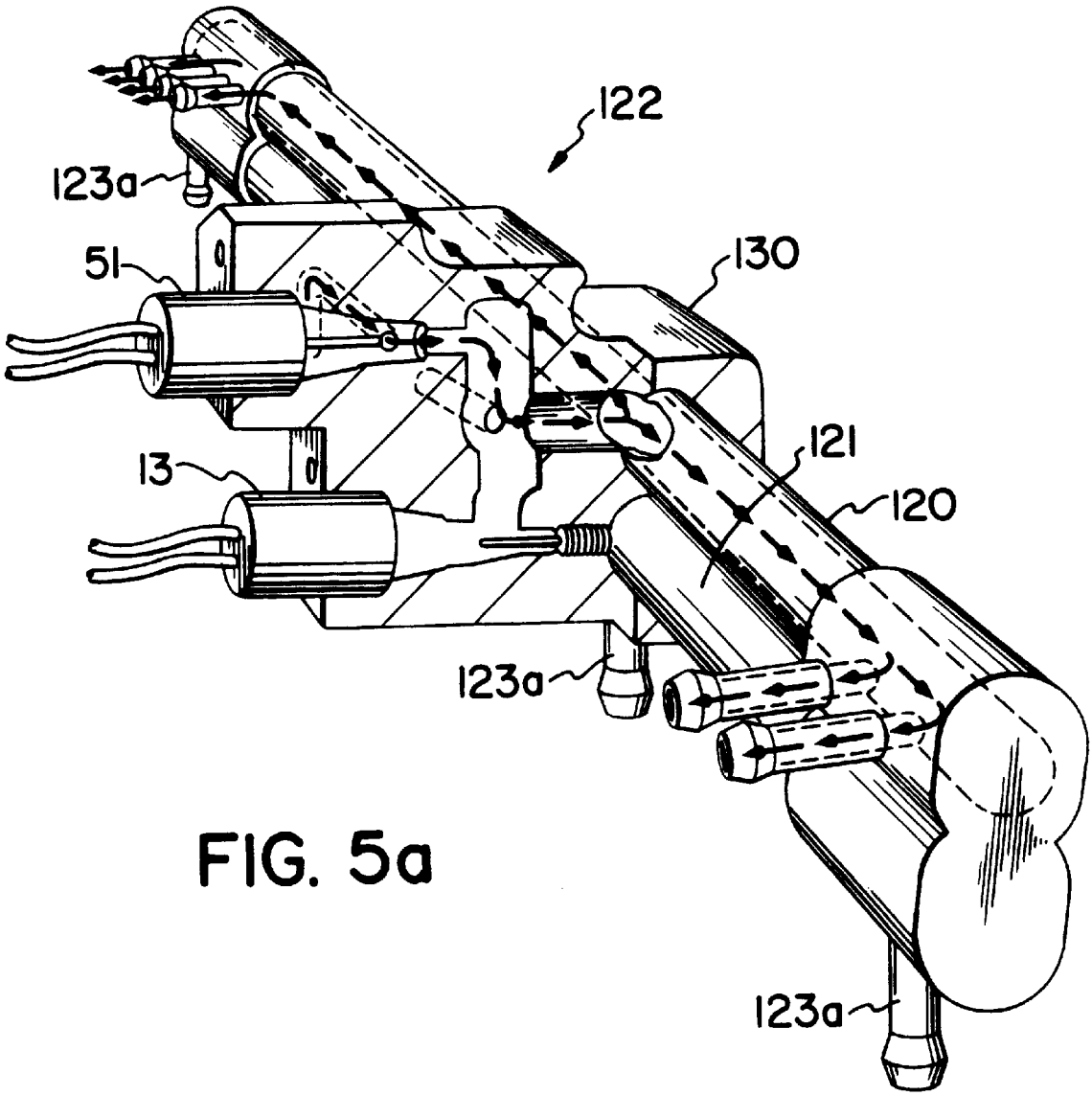
FIGS. 5*a* and 5*b* are perspective views showing two states of a manifold arrangement as included in the FIG. 4 embodiment of the fuel supply control system.
Figure 5B:
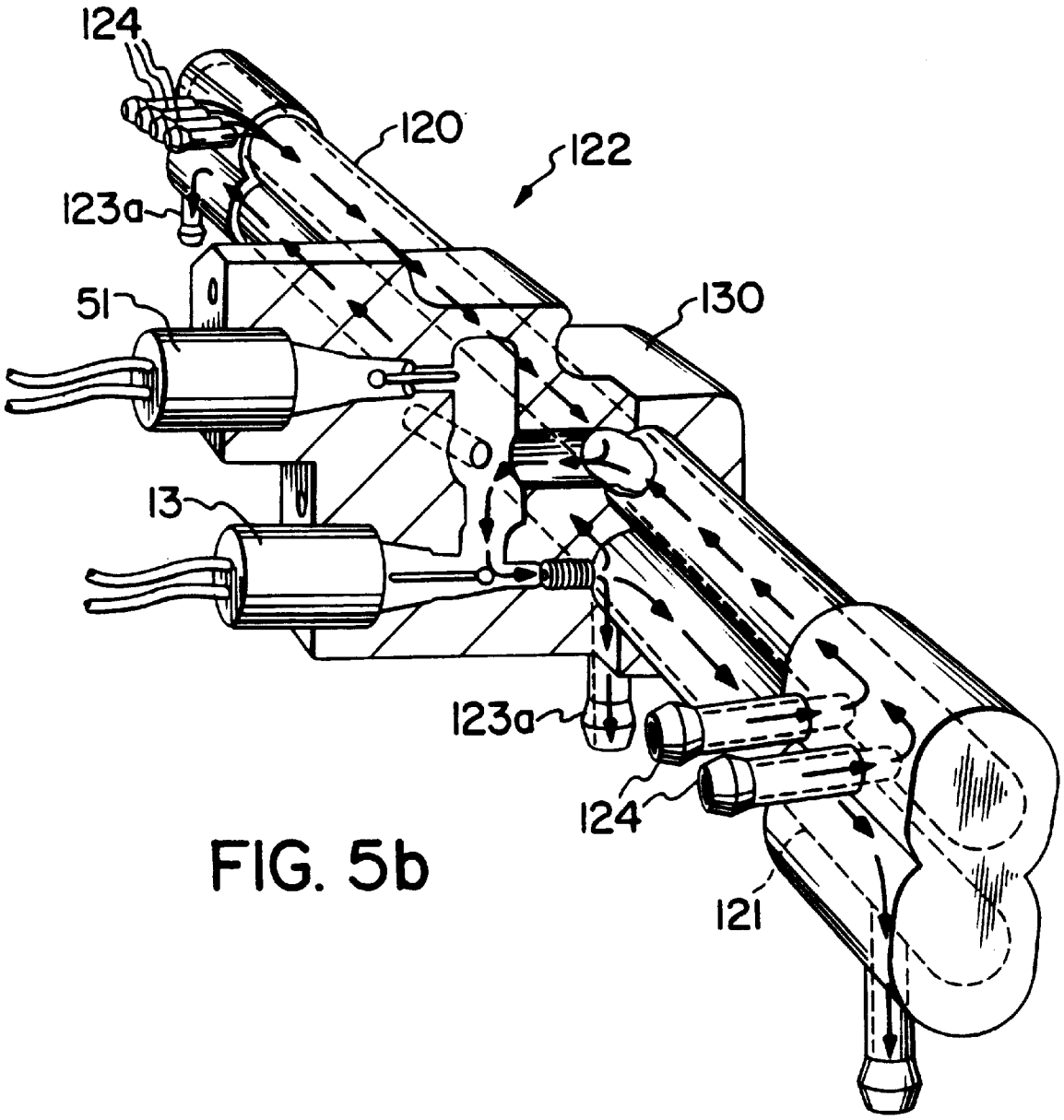
Figure 5C:
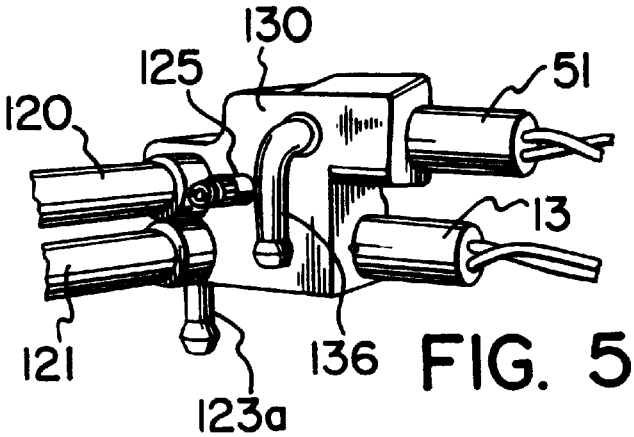
FIG. 5*c* is a perspective view from the opposite side showing a portion of the manifold of FIGS. 5*a* and 5*b*.

Referring to FIGS. 4 and 5*a* and 5*b*, the manifold 122 is shown as constituting a pair of closed end tubes 120, 121, access to the interior of which is controlled through a number of tubular connectors. The manifold 122 is designed for use with the three cylinder engine 30. Specifically, on the lower tube 121 at opposite ends thereof and in the middle are three tubular connectors 123*a* for communication with the vacuum conduits 123 that connect to the venturi of the respective carburettors 14. Three further pairs of tubular connectors 124 provide communication between the interior of the manifold upper tube 120 and the float chambers of the carburettors 14.

In an intermediate position in its length the manifold 122 carries a block 130 in which are received the solenoid valves 13 and 51 and the associated valve structure (not shown in FIG. 4). The block 130 also carries the atmospheric vent 125 and a further tubular connector 136 (FIG. 5C) to receive the pressure line 134.

As will be understood, within the block 130 the solenoid 13 controls communication of vacuum from the lower tube 121 to the upper tube 120 of the manifold, and thus application of pressure reduction to the carburetor float chambers. This is the condition represented by the arrows in FIG. 5*b*.

The solenoid 51 on the other hand controls communication of pressurized air flow from the connector 136 to the interior of the upper tube 120, and thus controls application of overpressure to the carburetor float bowls.

The full operating range of the system is calibrated such that for fuel enrichment (corresponding to cold start/warm up conditions) a 100% duty cycle for the solenoid 51 is provided at a predetermined ratio between atmospheric pressure and the pressure provided by the air pump 33. For reduction of the proportion of fuel in the air fuel mixture ratio (compensation for low atmospheric pressure or altitude) this system is calibrate to give 100% duty cycle operation of the solenoid valve 13 at a predetermined maximum ratio of negative (vacuum) pressure to atmospheric pressure. The effects of the duty cycle operation of the two solenoid valves 13 and 51 can to some extent offset one another e.g. for high altitude cold start situations.

Instead of the mechanical pump 33 described in relation to FIG. 3, it would of course be possible to utilize various other pump arrangements, and in particular a battery driven electric pump.

As is well understood, when an engine is cold it is difficult to vaporize a sufficient amount of the liquid fuel in the combustion chamber for the engine to operate properly. Vaporization and atomization are adversely affected by low temperature, and therefore in cold start conditions it is necessary to increase the quantity of fuel in order to compensate for poor atomization, and this is typically done by using a primer such as a choke or other enrichment system at the carburetor. As the engine gradually warms up during operation, the air fuel mixture atomizes and vaporizes more readily, and if the enriched mixture ratio is maintained, the engine performance will be reduced and the spark plugs may become fouled. The control system described herein and illustrated in the drawings overcomes this difficulty and will operate to enrich the air fuel mixture in cold start conditions, and automatically to reduce and remove the enrichment when the engine warms up. This is done by the electronic control unit 10 which receives signals from the engine temperature sensor 50 and modifies the pressure in the float bowls of the carburetors 14 as required to provide the necessary degree of mixture enrichment. The sensor 50 can be mounted at any convenient location on the engine 30, e.g. for a liquid cooled engine, within the engine coolant jacket. As described above in relation to FIG. 2, the pump 33 is driven by pressure pulses in the engine crankcase as communicated through the line 27 to deliver a flow of pressurized air through the line 134. This pressurized air is delivered to the block 130 through the connection 136 and enters the upper tube 120 of the manifold under control of the solenoid 13 which is driven by the ECU 10. Pressure from the tube 120 is communicated to the float bowls of the carburetors 14 through the tubes 124 to increase the pressure differential between the float bowls and the carburetor venturi and thus increase fuel flow to the extent required. As the engine temperature increases, the ECU 10 responds to signals from the sensor 50 to reduce the duty cycle of the solenoid 51, and thus reduce the overpressure applied to the carburetor float bowls until normal engine operating temperature is reached and this overpresure is completely eliminated.

The ECU 10 also controls the solenoid 13 in accordance with signals received from the air temperature sensor 12 which is conveniently located in the engine air filter (not shown) and from the barometric pressure sensor 11. The duty cycle of the solenoid 13 is controlled such that underpressure or vacuum from the lower tube 121 of the manifold (which communicates with the venturis of the carburettors through the lines 123) enters through the block 130 into the upper manifold tube 120 and hence acts to reduce the float bowl pressure of the carburetors 14 producing a leaner air fuel mixture corresponding to the reduced air density that occurs for example at increased altitudes.

The use of the manifold 122 as shown particularly in FIGS. 5*a* and 5*b* make it possible to use a single pair of solenoids 51, 13 to control the fuel flow in a number of carburettors (three as shown in the three cylinder engine of FIG. 4). Without the manifold, individual pairs of solenoids 13 and 51 would have to be provided for each respective carburettor 14.

The fuel control system as described in the foregoing can readily be provided as a retrofit on existing engines, and conveniently is provided in kit form the kit including a) the electronic control unit 10 together with the atmospheric pressure and temperature sensors and the engine temperature sensor;

b) the manifold 122 together with the block 130 including the connections for the various lines as described above;

c) the pump 33;

d) modified carburetors 14 including connections to the float bowls and venturis thereof; and e) electrical connections and pneumatic connections for coupling the various parts of the system.

What is claimed is:

1. A method for adjusting the air/fuel mixture ratio for an engine during a cold start, comprising:

(a) supplying fuel from a float chamber to a venturi of a caburetor to be mixed with air and delivered to said engine;

(b) generating a flow of pressurized air from pressure fluctuations within a crankcase of said engine;

(c) supplying said flow to a control unit by a connecting line;

(d) sensing the temperature of the engine and generating a signal when said temperature is below a normal operating temperature range;

(e) supplying said signal to said control unit; and (f) utilizing said flow to elevate the pressure within said float chamber to increase fuel flow into the venturi and thus increase the fuel content of said mixture during periods when said signal is received;

wherein said communication line delivers a flow of pressurized air at low speeds of rotation of the engine corresponding to cranking thereof, and wherein a mechanical pump, driven by pressure pulses generated in the crankcase chamber of the engine delivers the flow of pressurized air at speeds corresponding to idling and higher engine speeds.

2. A method as claimed in claim 1, wherein said pump is a diaphragm pump having a moveable diaphragm in its driving chamber side that is exposed to said pressure pulses, and in its pumping chamber side, having an inlet and an outlet respectively controlled by one way valves.

3. A fuel supply control system for controlling the air/fuel ratio for an engine that has a crankcase chamber which is subject to pressure fluctuations during operation, comprising:

an engine temperature sensor for generating a first signal indicative of engine temperature;

a pressure generator for producing a flow of pressurized gas in response to said pressure fluctuations in said crankcase chamber;

a control unit connected to said engine temperature sensor for selectively utilizing said first signal to apply pressure from said pressure generator to enrich the fuel content of said mixture when said first signal indicates an engine temperature that is below a normal range of engine operating temperatures;

said system including an elongate manifold having first and second closed hollow chambers, said first hollow chamber being in communication with a float chamber of each carburetor of said engine, said second hollow chamber being in communication with a venturi of each said carburetor;

communicating between said first and second hollow chambers being controlled by a solenoid valve connected therebetween;

a second solenoid valve being coupled to connect said flow of pressurized gas to said first chamber;

said first and second solenoid valves being driven in respective duty cycles by said control unit.

4. A manifold for use in a fuel supply control system for an internal combustion engine having a plurality of carburetors each having a float bowl from which fuel is supplied to a respective venturi, said manifold comprising:

elongate first and second closed chambers extending substantially parallel to one another;

each said chamber including flow connections for connecting the first chamber to the float bowl of each carburetor and for connecting the second chamber to the venturi of each carburetor;

a first valve for controlling delivery of a pressurized air flow to the first chamber, and a second valve for controlling air flow between said first and second chambers.

5. A kit of parts for providing a fuel supply control system on an engine in a vehicle, said kit of parts comprising:

(a) at least one sensor for sensing a condition selected from engine temperature, air pressure, and air temperature;

(b) an electronic control unit;

(c) a manifold for connecting to a plurality of carburetors of the engine, each carburetor having a float bowl from which fuel is supplied to a respective venturi, the manifold including, elongate first and second closed chambers extending substantially parallel to one another;

each chamber including flow connections for respectively connecting the first chamber to the float bowl of each carburetor and for connecting the second chamber to the venturi of each carburetor;

a first valve for controlling delivery of a pressurized air flow to the first chamber, and a second valve for controlling air flow between said first and second chambers;

(d) a pump for delivering a flow of pressurized air to said manifold;

(e) electrical connectors for coupling said electronic control unit to said at least one sensor and to said solenoid valve; and (f) pipe connectors to connect said pump to said manifold and for connecting said first and second manifold chambers to the engine carburetor.

6. A method for adjusting the air/fuel mixture ratio for an engine during a cold start, comprising:

(a) supplying fuel from a float chamber to a venturi of a carburetor to be mixed with air and delivered to said engine;

(b) generating a flow of pressurized air from pressure fluctuations within a crankcase of said engine;

(c) supplying said flow to a control unit by a connecting line;

(d) sensing the temperature of the engine and generating a signal when said temperature is below a normal operating temperature range;

(e) supplying said signal to said control unit; and (f) utilizing said flow to elevate the pressure within said float chamber to increase fuel flow into the venturi and thus increase the fuel content of said mixture during periods when said signal is received;

wherein, at cranking speed of said engine, said flow of pressurized air is generated through said connecting line, which is provided with a one-way flow valve to prevent reverse flow of pressurized air therein during intervals when pressure in the crankcase is reduced, and wherein, at speeds of idle and higher, said flow of pressurized air is generated by a diaphragm pump powered by pressure fluctuations within said crankcase.

7. A method as claimed in claim 6, wherein said control unit includes a solenoid valve and said flow is delivered to said flow chamber through said solenoid valve.

8. A fuel supply control system for controlling the air/fuel ratio for an engine that has a crankcase chamber which is subject to pressure fluctuations during operation, comprising:

an engine temperature sensor for generating a first signal indicative of engine temperature;

a pressure generator for producing a flow of pressurized gas in response to said pressure fluctuations in said crankcase chamber;

a control unit connected to said engine temperature sensor for selectively utilizing said first signal to apply pressure from said pressure generator to enrich the fuel content of said mixture when said first signal indicates an engine temperature that is below a normal range of engine operating temperatures;

a pressure sensor being connected to the control unit to deliver thereto a signal that is indicative of atmospheric pressure, said control unit being operative to reduce the fuel content of said mixture in proportion to reductions in atmospheric pressure signaled by said pressure sensor by applying a reduced pressure to a float bowl of a carburetor of the engine; and an air temperature sensor which is coupled to said control unit to provide a third signal thereto that is indicative of ambient air temperature, said control unit being operative to adjust the fuel content of said mixture to take account of variations in air density, said variations being proportional to ambient air temperature.

9. A method as claimed in claim 2, wherein the driving chamber side of the pump is connected to a first chamber of the engine crankcase and the inlet of the pumping chamber side of the pump is connected to a separate second chamber of the engine crankcase.

10. A fuel supply system for an engine, the control system being arranged to control the mass air/fuel mixture ratio delivered into the engine, the system comprising:

a first connecting line for connecting an interior of a float chamber of a carburetor of the engine to a venturi of the carburetor for exposing the float chamber to an air pressure at the venturi and adjusting a pressure on the fuel in the float chamber;

a control valve positioned in the first connecting line for controlling the flow rate and amount of pressure differential between the venturi and the fuel in the float chamber; and a control unit for controlling the valve to substantially maintain the mass air/fuel mixture ratio constant as atmospheric air density changes by increasing the pressure on the fuel in the float chamber with respect to the pressure in the venturi as air density increases and decreasing the pressure on the fuel in the float chamber with respect to the pressure in the venturi as air density decreases.

11. A fuel supply control system for an engine as in claim 10, and further comprising:

at least one sensor for sensing at least one of barometric pressure and atmospheric temperature and supplying such sensed information to the control unit;

wherein the control unit controls the control valve in accordance with the sensed information to maintain the substantially constant mass air/fuel mixture ratio.

12. A fuel supply control system for an engine as in claim 10, wherein the control unit controls a duty cycle of the control valve to control the flow rate of the valve.

13. A fuel supply control system for an engine as in claim 12, wherein the duty cycle is small at a standard operating altitude and is increased by the control unit to decrease the pressure differential between the venturi and the float chamber as the engine is operated at a higher altitude where the barometric air pressure is lower.

14. A fuel supply control system for an engine as in claim 13, wherein at a 100% duty cycle the vacuum in the float chamber will be approximately 40% of the vacuum at the venturi.

15. A fuel supply control system for an engine as in claim 14, wherein the first connecting line connects to the venturi adjacent an orifice for supplying fuel from the float chamber to the venturi.

16. A fuel supply control system for an engine as in claim 15, wherein the control unit is an ECU.

17. A method for controlling the mass air/fuel mixture ratio delivered into an engine from a carberot to compensate for changes in atmospheric air density, the method comprising:

connecting an interior of a float chamber of the carburetor to a venturi of the carburetor for exposing the float chamber to an air pressure at the venturi and adjusting a pressure on the fuel in the float chamber;

controlling the amount of pressure differential between the venturi and on the fuel in the float chamber to substantially maintain the mass air/fuel mixture ratio constant as the atmospheric air density changes by increasing the pressure on the fuel in the float chamber with respect to the pressure in the venturi as air density increases and decreasing the pressure on the fuel in the float chamber with respect to the pressure in the venturi as air density decreases.

18. A method as in claim 17, and further comprising:

sensing at least one of barometric pressure and atmospheric temperature and controlling the pressure differential in accordance with the sensed information to maintain the substantially constant mass air/fuel mixture ratio.

19. A method as in claim 18, wherein the pressure differential is controlled by controlling a duty cycle of a control valve interconnected between the venturi and the float chamber to control a flow rate of the control valve.

20. A method as in claim 19, wherein the duty cycle is controlled to be small at a standard operating altitude and is increased to decrease the pressure differential between the venturi and the float chamber as the engine is operated at a higher altitude where the barometric air pressure is lower.

21. A method as in claim 20, wherein at a 100% duty cycle the vacuum in the float chamber is controlled to be approximately 40% of the vacuum at the venturi.

22. A method as in claim 21, wherein the interior of the float chamber is connected to the venturi adjacent an orifice for supplying fuel from the float chamber to the venturi.

23. A method as in claim 15, wherein the controlling of the pressure differential is performed by an ECU.

* * * * *